United States Patent [19]

Leifeld

[11] Patent Number: 4,785,505

[45] Date of Patent: Nov. 22, 1988

[54] SLIVER OR LAP EVENING APPARATUS FOR A CARDING MACHINE OR THE LIKE

[75] Inventor: Ferdinand Leifeld, Kempen, Fed. Rep. of Germany

[73] Assignee: Trützschler GmbH & Co. KG, Mönchengladbach, Fed. Rep. of Germany

[21] Appl. No.: 26,489

[22] Filed: Mar. 16, 1987

[30] Foreign Application Priority Data

Mar. 14, 1986 [DE] Fed. Rep. of Germany ..... 3608514

[51] Int. Cl.[4] ..... D01G 23/04; D01G 15/40; D01G 19/08

[52] U.S. Cl. ..... 19/105; 19/106 R; 19/240

[58] Field of Search ..... 19/105, 240, 106 R

[56] References Cited

U.S. PATENT DOCUMENTS 4,506,413 3/1985 Leifeld ..... 19/105

FOREIGN PATENT DOCUMENTS 1797108 10/1959 Fed. Rep. of Germany .

1118068 11/1961 Fed. Rep. of Germany .

2359917 6/1974 Fed. Rep. of Germany .

2322942 4/1977 France .

*Primary Examiner*—Louis K. Rimrodt

*Attorney, Agent, or Firm*—Spencer & Frank

[57] ABSTRACT

A carding machine includes a licker-in and a main carding cylinder cooperating therewith; a feed roller arranged immediately upstream of the licker-in as viewed in a direction of material feed into the carding machine; and a feed table cooperating with the feed roller for advancing fiber material to the licker-in. The feed table is arranged for executing excursions towards and away from the feed roller as a function of the material quantity passing between the feed roller and the feed table and a measuring device operatively connected with the feed table for generating signals representing the excursions. There is provided a motor connected to the feed roller for rotating the same. The motor receives setting signals as a function of the excursions. The feed table has a movable first part operatively connected with the measuring device and a second part situated between the movable first part and the licker-in.

12 Claims, 4 Drawing Sheets

SLIVER OR LAP EVENING APPARATUS FOR A CARDING MACHINE OR THE LIKE

BACKGROUND OF THE INVENTION

This invention relates to an apparatus for evening the fiber sliver or fiber lap in a card, a roller card unit or similar machine which has a licker-in (fiber opening roller), a feed roller arranged immediately upstream of the licker-in as viewed in the direction of material feed, a feed table which cooperates with the feed roller and which is arranged to be relatively movable with respect to the feed roller for executing shifts relative to the feed roller as a function of the thickness (quantity) of the fiber material passing through the gap defined by the feed table and the feed roller. Further, with the feed table there is associated a measuring member which emits signals representing the relative displacement of the feed table and which is connected with the drive motor for the feed roller by means of a control device.

In a known apparatus disclosed, for example, in French published Application No. 2,322,942, underneath the stationarily held feed roller there is provided a stationary support, on which a plurality of sensor levers (feed table) are movably arranged. One end of each sensor lever is spring-loaded and is situated in the immediate vicinity of the licker-in. At the other end of each sensor lever there is arranged a measuring device (sensor pedal) which senses the shifts of the sensor lever as a function of the thickness of the material passing therethrough. It is a disadvantage of this arrangement that as the feed roller engages the fiber material and takes over the feed thereof, the working forces derived from the licker-in (tearing forces) exert an effect on the sensor levers and thus tend to distort the results of the measurements. It is another disadvantage of such a prior art arrangement that the measuring location in the clamping zone between the feed roller and the sensor levers extends over a relatively long path as viewed in the direction of article advance in which the feed roller is situated opposite the sensor levers and thus the location of the measurement is not accurately determinable.

SUMMARY OF THE INVENTION

It is an object of the invention to provide an improved apparatus of the above-outlined type from which the discussed disadvantages are eliminated and which in particular prevents interfering forces from effecting the measuring member and which establishes a determined location of measurement.

This object and others to become apparent as the specification progresses, are accomplished by the invention, according to which, briefly stated, the feed table has a movable first part and a second part; the measuring member is associated with the first part and the second part is situated between the first part and the licker-in.

Thus, according to the invention, the feed table is divided into at least two parts. By virtue of the fact that between the measuring member mounted on the movable first part of the feed table and the licker-in there is situated the second part of the feed table, there is provided a distance between the measuring location and the licker-in. This arrangement provides that while the licker-in may work on the fiber material backed up by the second part of the feed table, the licker-in has no interfering effect on the fiber material which is backed up by the first part, particularly at the measuring station. It is a further advantage of the invention that in the clamping zone between the movable first part of the feed table and the feed roller the measuring location extends over a very short zone or only along a line parallel to the axis of the feed roller or even is defined only by a point. In this manner, in contradistinction to the prior art construction, a measuring location is positively determined at all times. As a result, a constant path length between the measuring location and the transfer location of the fiber material at the licker-in (working location) is given. Dependent upon the fact whether, as a consequence of the control, more or less fiber material reaches the working location, more or less fiber material will be taken over by the licker-in.

According to an advantageous feature of the invention, the second part of the feed table is fixed so that the clamping of the fiber material between the feed roller and the second part of the feed table remains constant; the distance between the stationary feed roller and the second stationary part of the feed table thus remains unchanged.

According to a further advantageous feature of the invention, the fixed part of the feed table is situated between the licker-in and a vertical axial diametral plane of the feed roller. In case the terminal portion of the fixed part oriented away from the licker-in extends approximately to the vertical axial diametral plane of the feed roller, the licker-in also draws fibers of medium and large length without harmful pulling forces being exerted on the first movable part (measuring lever) of the feed table. Expediently, the outer end of the first, movable part of the feed table projects slightly beyond the vertical axial diametral plane of the feed roller in the direction of the licker-in. In this manner, the fiber material is securely drawn into the clamping zone between the feed roller and the first, movable part of the feed table. According to a further advantageous feature of the invention, the movable part of the feed table is rotatably supported by a stationary bearing. In some applications it is of advantage to arrange the bearing between the ends of the movable part and a force-exerting element such as a counter-weight or a spring is attached to that end of the movable part which is oriented away from the measuring location. Advantageously, the movable part is form-fittingly supported for movement in a vertical direction. According to a further feature of the invention, the movable part of the feed table is resiliently supported at both outer ends of the movable part. According to further advantageous features of the invention (which may be combined or may be present in separate structures), the movable part is supported on at least one leaf spring, the movable part is a one-piece construction which is structurally simple and is economical to manufacture, and the measuring member comprises a plunger armature cooperating with a plunger coil. By virtue of the latter arrangement, in case the movable part is supported for rotation, the torque about the bearing is measured. Preferably, the measuring member is a contactless analog proximity sensor such as a photocell sensor or the like.

DESCRIPTION OF THE PREFERRED EMBODIMENTS

Figure 1:
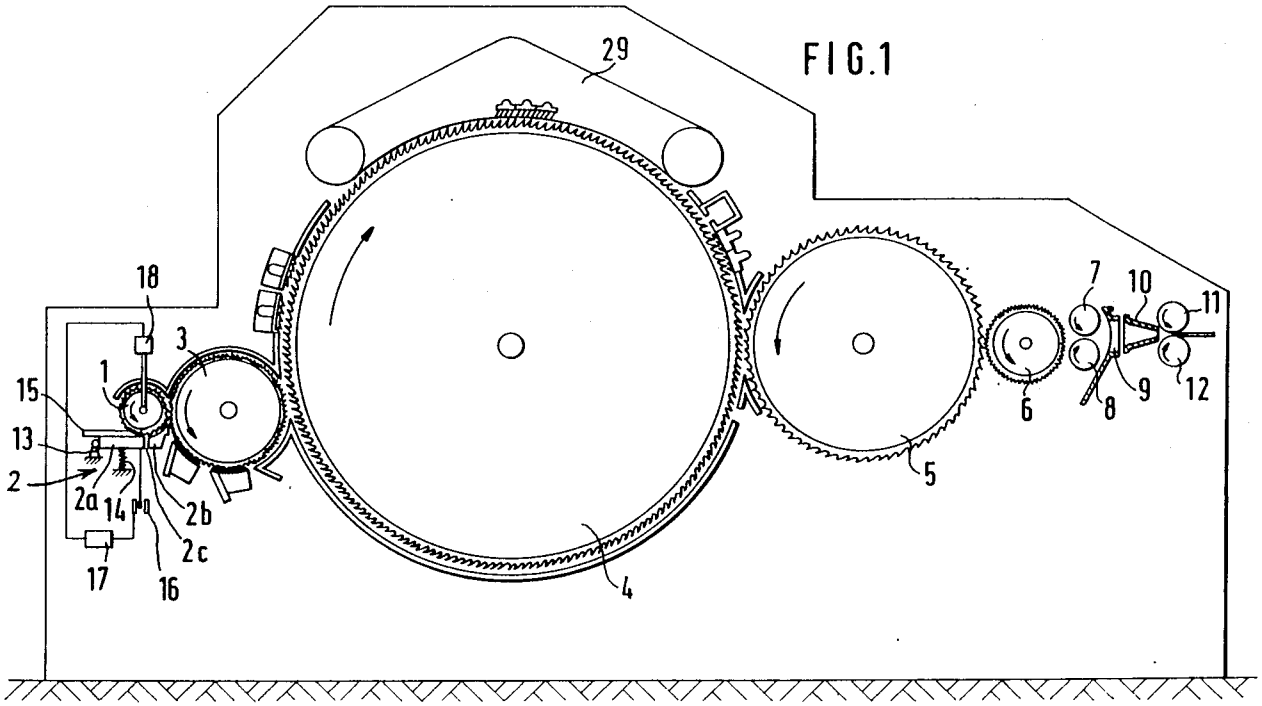
FIG. 1 is a schematic side elevational view of a carding machine incorporating a preferred embodiment of the invention.

Turning to FIG. 1, there is illustrated therein a carding machine which may be an "EXACTACARD DK 715" model manufactured by Trutzschler GmbH & Co. KG, Monchengladbach, Federal Republic of Germany. The carding machine has a stationarily supported feed roller 1, a feed table 2, a licker-in (fiber opening roller) 3, a main carding cylinder 4, a doffer 5, a stripper roller 6, crushing rollers 7 and 8, a web guiding element 9, a sliver trumpet 10, calender rollers 11 and 12 and travelling flats 29.

Figure 2:
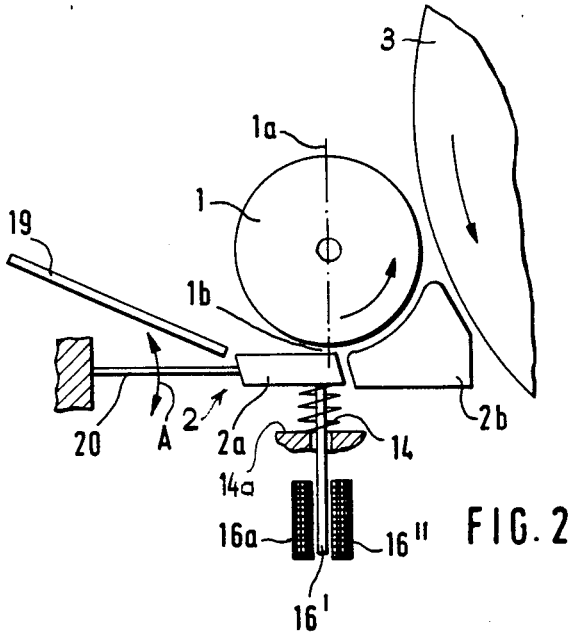
FIG. 2 is an enlarged schematic side elevational view of the preferred embodiment.

The feed table 2 is divided into a movable first part 2*a* and a stationary second part 2*b* arranged at a throughgoing clearance 2*c* from the movable first part 2*a*. The stationary part 2*b* is arranged between the licker-in 3 and the movable part 2*a*. That end of the stationary part 2*b* which is oriented towards the movable part 2*a* extends—as viewed from the licker-in 3—almost up to the vertical axial diametral plane 1*a* of the feed roller 1, as shown in FIG. 2. The other end of the stationary part 2*b* extends into the clearance between the feed roller 1 and the licker-in 3. The movable part 2*a* is at one end supported in a stationary rotary bearing 13. The other end of the movable part 2*a* oriented towards the stationary part 2*b* extends—as viewed from the rotary support 13—slightly beyond the vertical axial diametral plane 1*a* of the feed roller 1. The movable part 2*a* is biased by a compression spring 14 which presses against the underside of the part 2*a* and against a stationary counter support 14*a*.

The spring-biased movable part 2*a* is adapted to execute a shifting motion (excursions) with respect to the feed roller 1 as a function of the fiber material quantity 15 drawn in between the feed roller 1 and the movable part 2*a* of the feed table 2. With the movable part 2*a* there is associated a measuring member 16 which responds to the amount of displacement of the movable part 2*a* and which is connected with a drive motor 18 of the feed roller 1 by means of a control device 17. Thus, the movable part 2*a* executes excursions to an extent that corresponds to the thickness variations of the material. The excursions of the movable part 2*a* are sensed by the measuring member 16 and a corresponding signal is applied to the control device 17 which accordingly causes the drive motor 18 to accelerate or to slow down.

Figure 3:
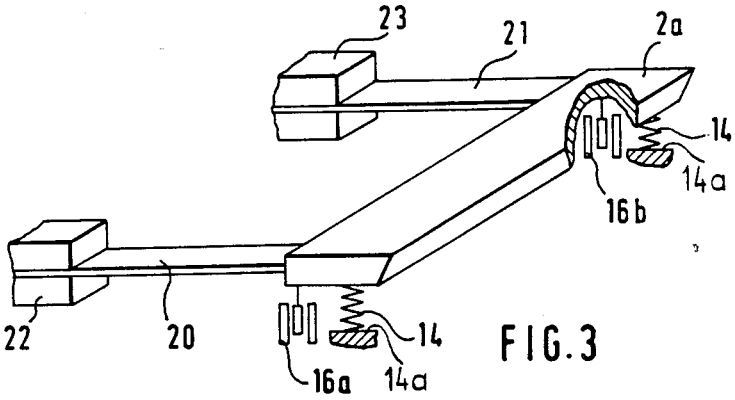
FIG. 3 is a perspective view of the structure illustrated in FIG. 2, including a slight modification.

Turning once again to FIG. 2, upstream of the movable part 2*a* there is provided a stationary transfer element 19 such as a sheet metal tray, on which the fiber lap is guided in the direction of the movable part 2*a*. The latter is of one-piece construction as illustrated in the perspective FIG. 3. At the two opposite ends of the part 2*a* there are arranged respective one ends of leaf springs 20, 21, whose other end is secured to a respective stationary machine component 22, 23. The leaf springs 20, 21 provide that the part 2*a* is movable substantially in a vertical direction, as indicated by the arrow A. At the two opposite lateral ends of the part 2*a* there are further arranged measuring components 16*a*, 16*b* each including, for example, a plunger armature 16' and an inductive plunger coil 16'', constituting an inductive path sensor/distance measurer operating in a contactless manner. The movable component 2*a* is supported in the zone of its two ends by respective compression springs 14. In the FIG. 2 embodiment the plunger armature 16' of the measuring element 16*a* (and 16*b*) and the respective compression spring 14 are coaxially arranged, whereas in the FIG. 3 structure the measuring members 16*a*, 16*b* and the respective compression springs 14 are arranged side by side. Between the feed roller 1 and the movable part 2*a* of the feed table 2 there is defined the narrow measuring location 1*b*.

Figure 4:
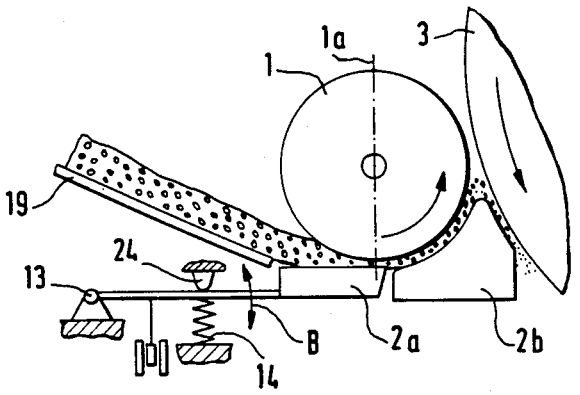
FIGS. 4–7 are schematic side elevational views of four further preferred embodiments of the invention.

Turning now to the embodiment illustrated in FIG. 4 which is similar to that of FIG. 1, above the movable part 2*a* there is disposed a stationary safety stop element 24 which prevents the movable part 2*a* from brushing against the clothing (not shown) of the feed roller 1. The outer end of the movable part 2*a* extends—as viewed from the rotary support 13—slightly beyond the vertical axial diametral plane 1*a* of the feed roller 1 in the direction of the licker-in 3. The movable part 2*a* rotates about the support 13 in the direction of the curved arrow B.

Figure 5:
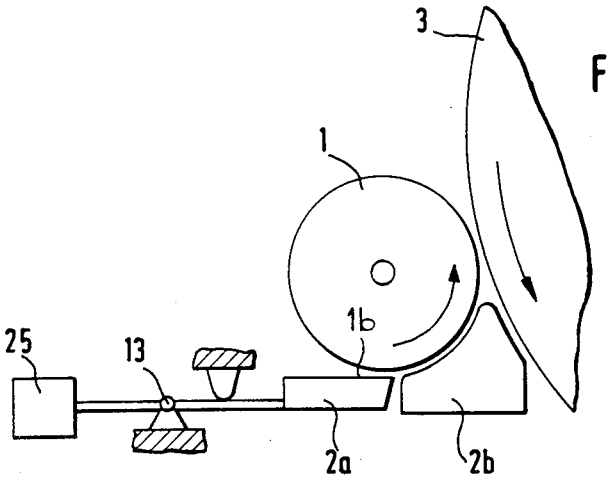

Turning now to the embodiment illustrated in FIG. 5, the rotary support 13 is arranged between the longitudinal ends of the movable part 2*a*. At that end of the part 2*a* which is oriented away from the measuring location 1*b*, a force-exerting element constituted by a counterweight 25 is arranged.

Figure 6:
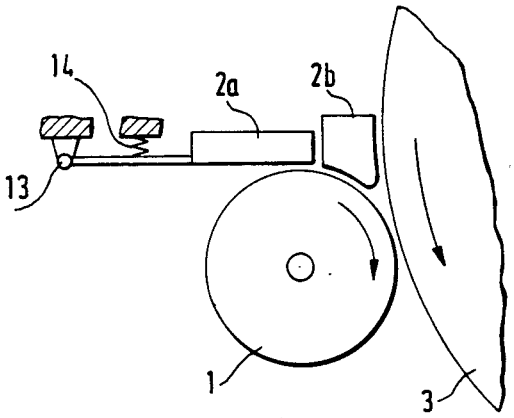

In the embodiment illustrated in FIG. 6 the movable part 2*a* and the stationary part 2*b* of the feed table are situated above the feed roller 1.

Figure 7:
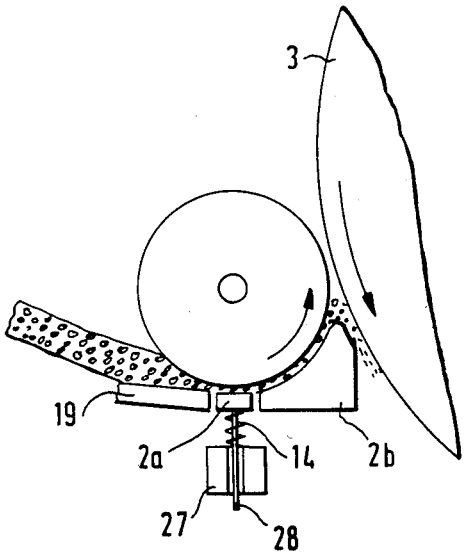

Turning to the embodiment shown in FIG. 7, the movable part 2*a* is positively guided in a vertical direction. For this purpose, there is provided a guide element 27 which effects a form-fitting guidance of a holding element 28 affixed to the movable part 2*a*. The compression spring 14 engages the part 2*a* and the guide element 27 which acts as a counter support for the spring 14.

The direction of rotation of the various rollers of the carding machine is illustrated by respective curved arrows drawn into the components shown in FIGS. 1, 2 and 4–7.

While the invention was described in connection with a carding machine, it will be understood that the invention may equally find application in similar machines such as roller card units, beaters, cleaners and the like.

It will be understood that the above description of the present invention is susceptible to various modifications, changes and adaptations, and the same are intended to be comprehended within the meaning and range of equivalents of the appended claims.

What is claimed is:

1. In a carding machine including a licker-in and a main carding cylinder cooperating therewith; a feed roller arranged immediately upstream of the licker-in as viewed in a direction of material feed into the carding machine; a feed table cooperating with the feed roller for advancing fiber material to said licker-in; said feed table being arranged for executing excursions towards and away from said feed roller as a function of the material quantity passing between the feed roller and the feed table and measuring means operatively connected with said feed table for generating signals representing said excursions; motor means connected to said feed roller for rotating said feed roller and means for applying setting signals to said motor for controlling said motor as a function of said excursions; the improvement wherein said feed table has a movable first part operatively connected with said measuring means and cooperating with said feed roller to define with said feed roller a measuring location for the fiber material and to execute said excursion towards and away from said feed roller; further wherein said feed table has a second part situated between said movable first part and said licker-in; said second part cooperating with said feed roller for advancing the fiber material to said licker-in.

2. A carding machine as defined in claim 1, wherein said second part is stationarily supported.

3. A carding machine as defined in claim 1, wherein said feed roller has an axial diametral plane oriented perpendicularly to the direction of material feed; said second part is situated in its entirety between said plane and said licker-in.

4. A carding machine as defined in claim 3, wherein said movable first part has an end portion projecting beyond said plane towards said licker-in.

5. A carding machine as defined in claim 1, further comprising a stationary bearing pivotally supporting said movable first part.

6. A carding machine as defined in claim 5, wherein said movable first part has a first end adjacent said feed roller and a second end being remote therefrom; said first and second ends being spaced from one another in the direction of material feed; said stationary bearing pivotally supporting said movable first part between said first and second ends; and a force exerting means connected to said second end for urging said first end towards said feed roller.

7. A carding machine as defined in claim 1, further comprising a stationary support means for holding and positively linearly guiding said movable first part.

8. A carding machine as defined in claim 1, wherein said movable first part has first and second ends spaced from one another transversely to said direction of material feed; further comprising means for resiliently supporting said movable first part at said first and second ends.

9. A carding machine as defined in claim 1, further comprising a leaf spring having a fixed first end and a swingable second end; said movable first part being affixed to said swingable second end.

10. A carding machine as defined in claim 1, wherein said movable first part is a single-piece component.

11. A carding machine as defined in claim 1, wherein said measuring means comprises a plunger coil and a plunger armature operatively connected with the plunger coil and being movable with respect thereto.

12. A carding machine as defined in claim 1, wherein said measuring means comprises a contactless analog distance sensor.

* * * * *